US005862939A

United States Patent [19]

McHenry et al.

[11] Patent Number: 5,862,939

[45] Date of Patent: Jan. 26, 1999

[54] FABRICATION PROCESS FOR METAL-POLYESTER CONSTRUCTION

[76] Inventors: Robert J. McHenry, 2819 Royal Ashdown Ct., St. Charles, Ill. 60174; Dominique Petit, Les Cotes F-38340, Pommiers-La-Placette, France

[21] Appl. No.: 737,813

[22] PCT Filed: Nov. 30, 1994

[86] PCT No.: PCT/US94/13920

§ 371 Date: Nov. 18, 1996

§ 102(e) Date: Nov. 18, 1996

[87] PCT Pub. No.: WO95/15284

PCT Pub. Date: Jun. 8, 1995

[30] Foreign Application Priority Data

Dec. 1, 1993 [FR] France ..... 93/14618

[51] Int. Cl.[6] ..... B65D 85/00

[52] U.S. Cl. ..... 220/623; 220/669; 156/73.1

[58] Field of Search ..... 220/623, 600, 220/608, 669, 660; 156/73.1

[56] References Cited

U.S. PATENT DOCUMENTS 2,568,029 9/1951 Seeman .

2,660,171 11/1953 Dickinson, Jr. .

2,753,868 7/1956 Seeman .

*Primary Examiner*—Joseph M. Moy

*Attorney, Agent, or Firm*—Hill & Simpson

[57] ABSTRACT

The invention is relating to a process of rolling the brim of a can of a metal-plastic-metal construction on a small diameter without provoking a crack in the metal layer (3) in the course of this folding operation. This process consists of reducing locally the thickness of plastic (2) in the zone (5) or (6) being rolled in order that the construction reduced to a thin layer of plastic (2) between two foils (3) and (4) of metal behaves nearly as a foil of homogeneous metal. The plastic flowed toward outside of the zone intended to be rolled forms a bulge either towards the exterior of this zone (7) or towards the interior (18). The process applies to food cans and to beverage cans of a metal-plastic-metal construction, as well as to the ends of these cans. The can bodies and ends fabricated by the process constitute equally an object of the invention.

21 Claims, 1 Drawing Sheet

FABRICATION PROCESS FOR METAL-POLYESTER CONSTRUCTION

TECHNICAL AREA OF THE INVENTION

The invention falls in the technical area of the fabrication by drawing or drawing and ironing starting from a layered metal-plastic construction, of cans for use for example in packaging of beverages or foods and of containers for aerosols or of can ends, whether easy-open or not.

More precisely, the metal-plastic construction used in the present invention is of the type metal-polymer=metal, that is in which a layer of polymer is interposed between two metal sheets to which it is adhered.

In the text of this patent application, we will use without distinction for the designation of this construction the terms metal-plastic-metal, metal-polymer-metal, or more simply in the abbreviated fashion, MPM.

DESCRIPTION OF THE PRIOR ART

There are numerous documents describing layered metal-plastic constructions intended for the fabrication of food cans, beverage cans, or can ends. However, the majority of these concern the metal-polymer or polymer-metal-polymer constructions, the metal-polymer-metal constructions being rarer.

By way of illustration one can cite the international PCT application filed on Jun. 25, 1981 by Metal Box Limited and published under the number WO 82/00020 on Jan. 7, 1982. This application has given birth in particular to the European patent EP 055 719.

This patent describes a metal-plastic construction composed in its simplest form of realization of a polyethylene (called for abbreviation PE) film attached to a foil or plate of metal. Another method of realization consists of two films of PE attached to opposite surfaces of a metal plate to form a complex PE-metal-PE. Finally, a third method of realization consists of two plates or foils of metals attached to opposite surfaces of a PE film. The PE used, obtained by copolymerization under a low pressure of ethylene and of butene-1, is of the type linear low density and it has been found that this particular type, whose characteristics are described in the application, has the interesting property of adhering directly to the metal without needing to use an adhesive. It suffices to adhere it to the metal by the simultaneous application of heat and pressure (heat sealing).

The metallic substrate can be steel, steel having a coating of tin, or of chrome, or of chrome/chrome oxide, or of zinc, of aluminum treated or not with nickel, copper, or zinc. It can have undergone a chemical conversion treatment.

In the examples given, the films of different types of polyethylene of 100 microns thickness are thus heat sealed on the plates of different metals; steel, tin plated steel, steel coated with chrome-chrome oxide, or aluminum of a thickness of 2310 microns. The specimens obtained are then formed into hollow articles by folding, stamping, drawing, wall-ironing. The adhesion of the coatings is compared and demonstrates the superiority of linear low density polyethylene.

The French patent FR2 665 887 (Pechiney Emballage Alimentaire) describes a capsule to fit over a cork made by drawing, drawing and ironing, or flow turning, characterized in that it is comprised of two layers of aluminum bound together by an adhesive layer of shore hardness less than 80. The adhesive layer can be constituted of an ethylene acrylic acid or of polyethylene, or of polypropylene modified with acid functionality. The total thickness of the complex is comprised between 120 and 400 microns with the following percentage distribution of the total thickness:

Outer layer of aluminum 20 to 50%

Adhesive layer 3 to 30%

Inner layer of aluminum 40 to 60%

PROBLEM POSED

The problem presented to the inventors was that of improving drawn can bodies, in particular for food, of drawn and ironed cans intended for beverages and their ends, whether they be easy-open or standard.

The forming process for food cans is the drawing-redrawing process, that of beverage cans is drawing and ironing, that of ends is drawing. All of these processes permits very high production rates.

In all cases, one begins by a drawing pass. One starts with a circular disc of steel or of aluminum alloys. For the ends, this disc is drawn in a single pass. For the food cans, it is drawn either in a single pass, or in two or several passes. In the latter case, the first pass gives an intermediate form in the shape of a cup which is then redrawn to reduce its diameter and increase its height. Finally, for the beverage cans, the form in the shape of a cup obtained by drawing in one or several passes is then ironed with the aid of a series of ironing rings, generally three in number, of decreasing internal diameters. There results from this a thinning and a corresponding elongation of the wall. All of these techniques are well known to one skilled in the art.

These cans and easy-open ends are coated internally by a food approved varnish and externally by one or several layers of decoration indicating the nature and the brand of the contained product.

Among the elements of cost of the cans and ends made by drawing or drawing and ironing, the cost of the metal, despite its slight weight, constitutes a preponderant portion. The idea had therefore occurred to the researchers of replacing a part of the metal by a less costly material: plastic. The cost of the usual polymers, polyolefins such as polyethylene (PE) or polypropylene (PP), polyesters (PET), polyamides is generally less, for an equal thickness than that of aluminum alloys.

The modulus of elasticity and the elastic limit of most plastic materials being much less than those of metals, the substitution of plastic for metal faces several structural problems. In addition to these structural problems, there are process problems tied to the fact that metal cans are generally fabricated under conditions considerably different from those used for forming plastics. For example, metal containers are normally fabricated at high speed and at ambient or moderate temperatures, whereas the behavior of plastics is such that plastic containers are fabricated normally at lower speed and at higher temperatures.

Previous researchers have shown that thin layers of plastic adhering well to a metal foil are able to be formed by simple modifications to the conventional metal forming process. This can be explained by the fact that the behavior of the metal-plastic construction during forming is controlled by the stronger and thicker metal and by the fact that the stresses generated in the thin plastic layer or layers are easily transferred to the metal foil as a result of their good adherence.

This restriction to relatively thin plastic layers has not been a problem in the previous research because the role of the plastic was in general to protect the metal against corrosion and that a relatively thin layer of plastic suffices for that protection.

To attain the objective of the present invention which is to reduce the thickness and, therefore, the cost of the metal used, the inventors have found that the plastic layer ought to be placed between two metal layers and ought to be thicker than those attained up until now in the containers made of metal-plastic constructions.

The improvement of the toughness of the MPM constructions, characterized by their elongation to rupture has permitted successful drawing of MPM structures with the relative thicknesses of plastic significantly higher than had ever been achieved.

It is thus that for the drawn and ironed beverage cans, the inventors have developed a metal-plastic construction constituted of a central layer of thermoplastic polymer of thickness P coated on each of its internal and external faces with metal foils of respective thicknesses Mi and Me, such that the ration P/(Mi+Me) is greater than 0.5. By way of example, the thickness P of the polymer is between 100 and 500 microns and the thickness Mi or Me of each of the metal foils is between 25 and 150 microns.

The same metal-plastic construction is useful for drawn food cans and their ends. For the cans, the thickness P of the polymer is between 100 and 500 microns and the thickness Mi or Me of each of the metal foils is between 25 and 150 microns. For the ends, the thickness P of the polymer is between 80 and 300 microns and the thickness Mi or Me of each of the metal foils is between 25 and 100 microns.

To fabricate a can starting from a can body, one first proceeds to trim the body to height by shearing the upper part of the walls, then to neck this upper part. The upper edge ought to be then rolled to a small radius of curvature to permit the seaming of the end after filling the can. Because, in the course of this operation of bending the metal-plastic construction according to this small radius, one observes that the metal foil the farther from the center of curvature, that which is in extension, breaks at the point where the radius is the smallest, the other metal foil remaining intact. This phenomenon, for reasons which it would take too long to explain here, does not occur with a homogeneous metal of the same thickness without a polymer layer. Faced with this problem, the inventors have first of all searched for a solution, then have rapidly set forth the hypothesis that this rupture of the metal foil in extension had no effect on the mechanical strength of the can which had been filled and seamed. What could be feared, in effect, is that a can with a rolled flange in which one of the two metal foils is ruptured would not be able to resist the tensile stresses created by the internal pressure which tends to detach the end. However, the internal stresses in the axial direction of a pressurized cylinder are approximately half of those in the direction perpendicular to the axis. Thus, if there is enough metal in the complete metal-plastic construction, with its two layers of metal, to resist the stresses in a plane perpendicular to the axis, there is enough metal in the remaining intact layer to resist the axial stresses. This hypothesis has been confirmed by calculations. Moreover, the total thickness in the brim is, in general, higher than that of the thinnest part of the wall, which gives a margin of safety. It is also possible for reinforcing the can to choose for the external foil a higher thickness or a stronger alloy than for the internal layer. Finally, the exterior appearance of the can will not be affected since the broken part of the metal foil will be covered by the folded edge of the end in such a way that the final user of the can will not even notice it.

On the contrary, for the ends of which the rims ought also to be rolled to a small radius in view of seaming, the problem remains undiminished.

OBJECT OF THE INVENTION

The object of the invention is a process permitting rolling the rims of an end made of a MPM construction to a small diameter without provoking cracks in the metal layer brought into extension in the course of this folding operation.

This process consists of reducing locally the thickness of the plastic in the zone which ought to be rolled in order that the construction reduced to a thin layer of plastic between two metal foils acts pretty nearly like a foil of homogeneous metal. Although this process, in the same way as has been explained above, is not indispensable for rolling the upper part of the can body, it could equally be applied to it. In the following description and figures, the ends will be nearly exclusively mentioned, but the process applies also to the can bodies.

The can bodies and ends fabricated by the above process equally constitute an object of the invention.

DESCRIPTION OF THE INVENTION

The inventors have started from the observation that this phenomenon of cracking of the metal layer which is in extension observed on the MPM constructions when one folds them to a small radius doesn't happen with a homogeneous metal foil, as this has been explained above. They have also remarked that the radius of curvature about which one is able to bend the MPM structure without breaking either of the layers was proportionately smaller with the total thickness of the structure and in particular as the polymer core was slight. They had had the idea of reducing the thickness of the layer of central plastic material uniquely in the annular exterior zone where the end should be rolled.

The process used consists of flowing in exercising a pressure, the central plastic in a fashion so that at the place where this pressure is exerted, the thickness of the polymer would be reduced in a proportion of a least 50% such that folding becomes possible without rupture of the external layer of metal.

It is evidently necessary that while the pressure is exerted, the plastic be sufficiently fluid that it can flow. It is necessary therefore to bring it to a temperature above its softening point and, preferably, above its melting point. This is achieved easily by a localized heating on an exterior ring of the end. The operation of flow of the plastic occurring in the production line of the end which operates at high speed, one will choose a rapid mode of heating, for example induction heating. The process includes two successive and nearly simultaneous steps.

localized heating of the rim of the end to a temperature above that of softening and, preferably, that of melting;

application of a pressure on the peripheral zone of the end to flow a part of the plastic of this zone.

An important question from the practical point of view is the recovery of the expelled plastic. Two possibilities have been tried.

The first consists of expelling the plastic towards the exterior. In this case, the plastic thus expelled proceeds to add itself to the plastic already present in the annular exterior zone. It contributes then to increasing the thickness of it, thus forming an annular bulge of a diameter greater than the diameter of the zone corresponding to the thickness reduction.

If the zone of which the plastic thickness is reduced is very close to the exterior diameter of the end, a part of the plastic will effectively be expelled to the exterior forming thus a supplementary ring of plastic around the exterior diameter of the end.

In accordance with this case, this ring of plastic will be used to improve the leak proofing of the end on the can or it will be trimmed in a manner to separate it from the end.

The second solution consists of flowing the plastic towards the center of the end where it will form a light annular bulge which will permit the improvement of the mechanical qualities of the end and, in particular, its rigidity.

Figure 1:
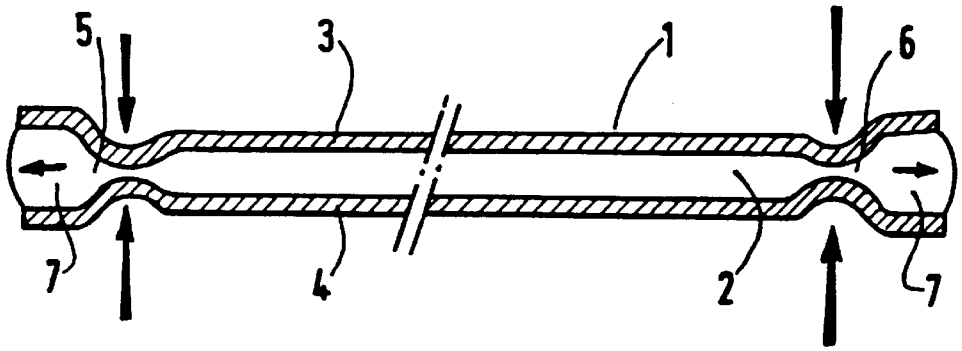
FIG. 1 represents one of the variants of the invention in which a local reduction of the plastic thickness occurs by flow towards the exterior.
Figure 2:
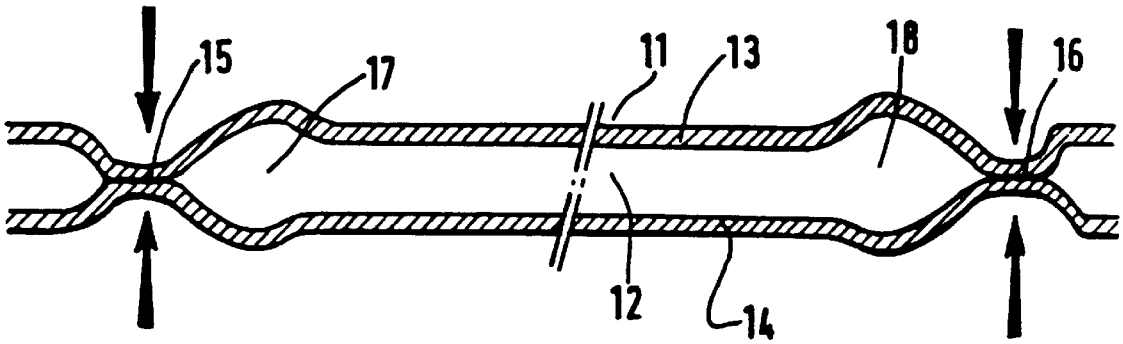
FIG. 2 represents one of the variants of the invention in which the local reduction of the plastic thickness occurs by flow towards the center of the end.

FIGS. 1 and 2 illustrate the one and the other of these two solutions.

FIG. 1 represents the elimination of a part of the plastic towards the exterior. A form of circular end viewed in cross section along a diameter (1) is constituted of a core in plastic material (2) and of two metal foils (3) and (4). One heats the circular rim of the form on all of its circumference: zone (5) and (6) in a fashion to soften or even to melt the plastic. This zone corresponds to that where the end will be rolled on a small diameter. One then applies on all of the periphery of the form a pressure represented by the arrows. The liquid or at least softened plastic flows toward the exterior and forms a bulge toward the exterior of the end. The zone where a part of the plastic material has been eliminated can then be folded on a small radius without fissures being observed.

FIG. 2 represents the elimination of the plastic towards the center of the end. A form of circular end viewed in cross section along a diameter (11) is constituted of a core of plastic material (12) and of two metal foils (13) and (14). One heats an annular zone of the form at a slight distance from the rim (15) and (16) in a fashion to soften or even to melt the plastic. One then applies on all the periphery of the form a pressure represented by the arrows and exerting itself on the zone where the end will be rolled. The liquid or at least softened plastic is not able to flow toward the exterior since the brim itself is not heated and that the plastic there, therefore, has remained solid. It will flow, therefore, towards the center of the end and is going to form a bulge (17), (18), situated still in the heated zone and which absorbs the plastic expelled by the pressure. The brim of the form from where the plastic material has been eliminated or nearly eliminated is able then to be folded on a small radius without cracks being observed.

The process described above can be applied equally in these two variants to the upper part of the can walls. The principal remains the same: one heats the upper part of the wall and the pressure, instead of being applied perpendicularly to the plane of the end, is applied radially.

The easy-open or standard open ends and the cans of a metal-plastic construction of the type metal-polymer-metal, according to the invention, are characterized in that at the place where, in view of seaming, the end or the can ought to be rolled on a small diameter, the thickness of the plastic material forming the core has been reduced at least 50%.

For the cans as well as for the ends, it is possible and recommended to use recycled polymers.

EXAMPLES

Example 1

A strip of polypropylene of 140 microns thickness has been coated on each of its faces with a layer of 5 microns thick adhesive constituted of a film of maleic acid modified polypropylene. The two films of adhesive have been applied on the film by cold passage between rollers. The composite strip thus obtained has then been introduced continuously between two foils of 80 microns thickness of aluminum alloy 3003, alloy of manganese according to the "Aluminum Association" standards and preheated by passage in an oven at a temperature of 200° C. in a fashion to melt the adhesive. The MPM construction obtained has then been introduced between rollers for heat sealing it. Starting from this construction, circular discs of 75.4 mm diameter have been cut out. These discs have then been drawn to give ends of 65 mm diameter. Before proceeding to roll the brims, these brims have been treated according to the scheme of FIG. 1 in heating them by induction to a temperature of 200° C. in a fashion to melt the plastic. A pressure of 1500 Kpa has been applied on the perimeter of the end in a fashion to expel a part of the central plastic of the heated zone. The brims of the covers have then been rolled in view of seaming. In the course of this operation, no cracks of the metal nor of the plastic has been put in evidence.

Example 2

A layer of low density polyethylene of 150 micron thickness has been extruded between two foils of 80 microns thickness of aluminum preheated by passage in an oven at a temperature of 200° C. without interposition of adhesive. The MPM construction obtained was then passed between rollers for heat sealing. Starting from this construction, circular discs of 75.4 mm diameter were cut out. Before proceeding to the rolling of the brims, these brims have been treated according to the scheme of FIG. 2 in heating them by induction to a temperature of 200° C. in a fashion to melt the plastic in a zone near the edge but at a small distance. A pressure of 1500 Kpa has been applied on the perimeter of the end in a fashion to expel a part of the plastic of the core from the heated zone toward the center of the end. The brims of the ends have then been rolled in the zone emptied of its plastic core in view of seaming. In the course of this operation, no cracking of the metal nor of the plastic has been put in evidence.

Example 3

A layer of polyester of 150 microns of thickness has been extruded between two foils of 80 microns thickness of aluminum preheated by passage in an oven at a temperature of 280° C. without interposition of adhesive. The MPM construction obtained was then passed between rollers for thermosealing it. Starting from this construction circular discs of 75.4 mm diameter have been cut out. Before proceeding to roll the brims, these brims have been treated according to the scheme of FIG. 2 in heating them by induction to a temperature of 280° C. in a fashion to melt the plastic in a zone near the edge, but at a small distance. A pressure of 1500 Kpa has been applied on the perimeter of the end in a fashion to expel a part of the plastic of the core from the zone heated towards the center of the end. The brims of the ends have been then rolled in the zone emptied of its plastic core in view of this seaming. In the course of the operation, no cracks of the metal nor of the plastic have been put in evidence.

We claim:

1. A can end comprising:

an end body having a generally circular disc-like configuration with a peripheral edge, said end body having a metal-polymer-metal laminate construction. $M_i$—P—

$M_e$, wherein $M_i$ and $M_e$ are each metal layers and P is an intermediate polymer layer having a first thickness dimension, said end body further including an annular region defined adjacent the peripheral edge, the intermediate polymer layer P in said annular region having a reduced second thickness dimension which is reduced in thickness as compared to the first thickness dimension by at least 50% said annular region including a rolled portion adapted to be rolled together with a rolled brim of a can body to define a rolled brim seam for a food can container or a beverage can container, said rolled portion being rolled to a small radius of curvature such that one of the metal layers is in compression and the other metal layer is in extension and wherein the metal layer which is in extension in the rolled portion is substantially crack free.

2. A can end as defined in claim 1, wherein each metal layer has a thickness of from about 25 to about 100 microns and the first thickness dimension of said intermediate polymer layer is from about 80 to about 300 microns.

3. A can end as defined in claim 1, wherein said end is an easy-open end.

4. A can end as defined in claim 1, wherein said intermediate polymer layer is selected from the group consisting of: polyethylene, polypropylene, polyester and polyamide.

5. A can end as defined in claim 1, wherein metal layers $M_i$ and $M_e$ are selected from the group consisting of steel and aluminum alloys.

6. A can end as defined in claim 1, further including a coating of a food approved varnish on a surface of said end body.

7. A can end as defined in claim 2, wherein in the laminate construction, the thickness dimension of each metal layer is the same.

8. A can body comprising:

a drawn and ironed can body including a wall having an upper end, said can body having a metal-polymer-metal laminate construction including an intermediate polymer layer having a first thickness dimension, said can body further including a region adjacent the upper end, the intermediate polymer layer in said region having a reduced second thickness dimension which is reduced in thickness as compared to the first thickness dimension by at least 50%, said can body further including a rolled portion in said region which is rolled to a small radius of curvature such that one of the metal layers is in compression and the other metal layer is in extension and wherein the metal layer which is in extension in the rolled portion is substantially crack free.

9. A can body as defined in claim 8, wherein each metal layer has a thickness of from about 25 to about 150 microns and the first thickness dimension of said intermediate polymer layer is from about 100 to about 500 microns.

10. A can body as defined in claim 8, wherein said intermediate polymer layer is selected from the group consisting of: polyethylene, polypropylene, polyester and polyamide.

11. A can body as defined in claim 8, wherein said metal layers comprise aluminum alloy.

12. A can body as defined in claim 9, wherein in the laminate construction, the thickness dimension of each metal layer is the same.

13. A can body as defined in claim 9, wherein in the laminate construction, the thickness dimension of each metal layer is not the same.

14. A method for rolling a peripheral portion of a can end having a metal-polymer-metal laminate construction to a small radius of curvature preparatory to seaming the can end to a can body, said method comprising the steps of:

providing a can end including an end body having a generally circular, disc-like configuration with a peripheral edge, said end body having a metal-polymer-metal laminate construction including an intermediate polymer layer having a first thickness dimension;

locally heating an annular peripheral portion of said end body adjacent the peripheral edge to a temperature above a softening point of said intermediate polymer layer to render the polymer layer in said annular peripheral portion flowable;

applying localized inward pressure on said end body at said heated annular peripheral portion to flow polymer present therein to reduce the thickness dimension of the intermediate polymer layer of said annular peripheral portion to a reduced second thickness dimension reduced in thickness as compared to said first thickness dimension by at least 50% to provide an annular peripheral rolling zone; and thereafter, rolling said annular peripheral rolling zone to a small radius of curvature, such that one of the metal layers is in compression and the other metal layer is in extension and wherein the metal layer which is in extension is substantially crack free.

15. A method as defined in claim 14, wherein in said applying step, localized inward pressure is applied in a manner which causes softened polymer in said annular peripheral portion to flow inwardly away from said peripheral edge.

16. A method as defined in claim 14, wherein in said applying step, localized inward pressure is applied in a manner which causes softened polymer in said annular peripheral portion to flow toward said peripheral edge.

17. A method for rolling a lip portion of a can body having a metal-polymer-metal laminate construction to a small radius of curvature preparatory to seaming the can body to a can end, said method comprising the steps of:

providing a drawn and ironed can body including a wall having an upper end, said can body having a metal-polymer-metal laminate construction including an intermediate polymer layer having a first thickness dimension;

locally heating an annular portion of said wall adjacent the upper end to a temperature above a softening point of said intermediate polymer layer to render the polymer layer in said annular portion flowable;

applying localized radial pressure on said can body at said heated annular portion to flow polymer present therein to reduce the thickness dimension of the intermediate polymer layer of the annular portion to a reduced, second thickness dimension reduced in thickness as compared to said first thickness dimension by at least 50% to provide an annular rolling zone; and thereafter, rolling said annular rolling zone to a small radius of curvature. such that one of the metal layers is in compression and the other metal layer is in extension and wherein the metal layer which is in extension is substantially crack free.

18. A method as defined in claim 17, wherein in said applying step, localized radial pressure is applied in a manner which causes softened polymer in said annular portion to flow toward said upper end.

19. A method as defined in claim 17, wherein in said applying step, localized radial pressure is applied in a manner which causes softened polymer in said annular portion to flow away from said upper end.

20. A can end as defined in claim 1, wherein said end body further includes a ring of plastic projecting outwardly from the intermediate polymer layer P along the peripheral edge.

21. A can end as defined in claim 1, wherein said end body further includes an annular bulge portion disposed adjacent the annular region on a side opposite the peripheral edge, the intermediate polymer layer P in the annular bulge portion having a third thickness dimension larger than said first thickness dimension.

* * * * *